US006424330B1

(12) United States Patent
Johnson

(10) Patent No.: US 6,424,330 B1
(45) Date of Patent: Jul. 23, 2002

(54) ELECTRO-OPTIC DISPLAY DEVICE WITH DC OFFSET CORRECTION

(75) Inventor: Mark T. Johnson, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/303,318

(22) Filed: Apr. 30, 1999

(30) Foreign Application Priority Data

May 4, 1998 (EP) ..... 98201438

(51) Int. Cl.[7] ..... G09G 3/36
(52) U.S. Cl. ..... 345/96; 345/209; 345/87
(58) Field of Search ..... 345/87, 90–96, 345/98–100, 204, 205, 211, 212

(56) References Cited

U.S. PATENT DOCUMENTS 5,191,455 A * 3/1993 Hashimoto et al. ..... 345/96
5,428,370 A * 6/1995 Knapp et al. ..... 345/205
5,515,390 A * 5/1996 Benton ..... 714/811
5,751,279 A * 5/1998 Okumura ..... 345/212
5,812,106 A * 9/1998 Hughes ..... 345/90
5,905,484 A * 5/1999 Verhulst ..... 345/98

FOREIGN PATENT DOCUMENTS

JP 10048598 A * 2/1998 ..... G02F/1/133

* cited by examiner

*Primary Examiner*—Richard Hjerpe
*Assistant Examiner*—Alexander Eisen

(57) ABSTRACT

A display device has a measuring circuit (14) to detect flicker due to the presence of a DC voltage by monitoring the pixel voltage and, if necessary, modifying driving signals.

17 Claims, 3 Drawing Sheets

ELECTRO-OPTIC DISPLAY DEVICE WITH DC OFFSET CORRECTION

BACKGROUND OF THE INVENTION

The invention relates to a display device comprising an electro-optical material between two substrates, at least one of which is transparent, and a first substrate is provided with at least one picture electrode at the location of a pixel, each pixel being coupled to a row electrode and a column electrode, control means comprising first drive means for applying a selection signal to the row electrodes and second drive means for applying a data signal to the column electrodes.

Display devices of this type are used in, for example, televisions, monitors, laptop computers, etc.

Usually, the second substrate comprises one or more counter electrodes but this is not strictly necessary as in, for example, the case of "in-plane switching" (IPS).

Display devices of the type described above are generally known and are usually driven by means of alternating voltages across the pixels (AC driving) so as to prevent degeneration of the liquid crystal materials. Nevertheless, it has been found that, due to different causes, a parasitic DC component may be produced across the layer of liquid crystal material. This is particularly the case when the pixels have an asymmetrical structure, as is the case, for example, in reflective display devices (in which the display device comprises a reflector, or the picture electrodes on one of the substrates are reflecting).

Said DC component affects the drive of a pixel differently for opposite polarities in successive frame times. When the absolute voltages across a pixel in successive frame times (at the same data) differ, this will give rise to flicker at half the frequency of the frame frequency used (generally 50 or 60 Hz) which is very clearly visible in the image.

OBJECTS AND SUMMARY OF THE INVENTION

It is, inter alia, an object of the invention to provide a display device of the type described above, in which the above-mentioned drawbacks are at least partly obviated.

To this end, a display device according to the invention is characterized in that the display device comprises a measuring element, and the control means comprise means for applying a voltage to the measuring element during a selection period and for measuring the variation of the voltage across the measuring element after the selection period, and for adapting, dependent on the measured voltage variation, at least one of the control voltages of the display device generated by the control means.

The control voltage to be adapted is, for example, a voltage of a line selection signal, a data signal, a reference voltage of the display device (for example, a reset voltage, or the voltage across a control electrode) or, when the second substrate comprises at least one counter electrode, the voltage of a signal across the counter electrode.

The invention is applicable to display devices of the passive and active type.

For example, a line selection period of the display device is chosen for the selection period.

It is found that the parasitic DC component may give rise to differences in the (measured) voltage variation in the different (positive and negative) frame periods. When driving pixels, this difference leads to said flicker. By comparing the variation of the voltage after two consecutive selection periods (or in two consecutive frame periods) with each other and by adapting one of the control voltages, dependent on the measured result, the flicker is reduced considerably.

In a first implementation (active display device), each pixel is coupled to the row electrode or the column electrode via a switching element. In this case, the measuring element may be constituted by, for example, a row of pixels, but preferably the display device is provided with a row of extra (dummy) pixels.

The measured voltage difference can be compared with a variation stored in advance in the control means, for example when the display device is adjusted in advance.

A preferred embodiment of a display device according to the invention is, however, characterized in that the control means comprise means for reversing the sign of the polarity of the voltage across the measuring element and for measuring the difference between the voltage directly after the selection period and the voltage just before a subsequent selection period, and means for adapting the control voltage of the display device in such a way that the absolute value of the voltage difference for both polarities is substantially the same. A small number of measurements may then be sufficient. In this case, measurement and correction take place continuously. In another implementation, measurement and correction are performed once, for example when switching on the display device, or periodically.

When used in passive displays, for example, a measuring element (outside the actual display section) is used which is directly driven from the control means.

BRIEF DESCRIPTION OF THE DRAWINGS

These and other aspects of the invention are apparent from and will be elucidated with reference to the embodiments described hereinafter.

In the drawings:

FIG. 1 is a diagrammatic cross-section of a part of a display device while

FIGS. 3 to 5 show drive signals and an internal signal of the display device, while

DESCRIPTION OF THE PREFERRED EMBODIMENTS

Figure 1:
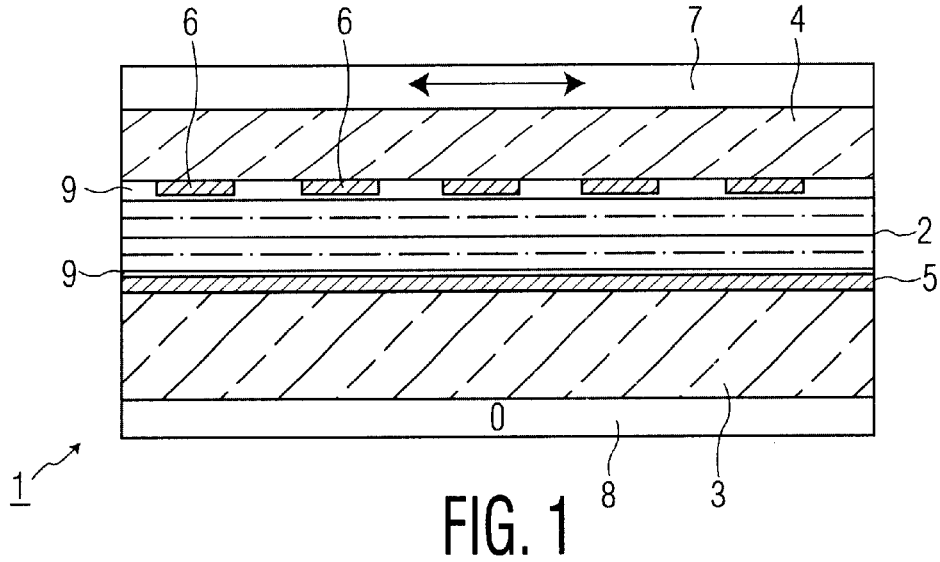

FIG. 1 is a diagrammatic cross-section of a part of a liquid crystalline display device 1, for example of the size of a few pixels, comprising a liquid crystal cell with a twisted nematic liquid crystalline material 2 which is present between two substrates 3, 4 of, for example, glass provided with, for example, transparent (ITO) picture electrodes 6 and a reflecting counter electrode 5. The device further comprises two polarizers 7, 8 whose directions of polarization are mutually crossed perpendicularly. The cell further comprises orientation layers 9 which orient the liquid crystalline material on the inner walls of the substrates. In this case, the liquid crystalline material has a positive optical anisotropy and a positive dielectric anisotropy. If the electrodes 5, 6 are energized by an electric voltage, the molecules and hence the directors direct themselves to the field.

Figure 2:
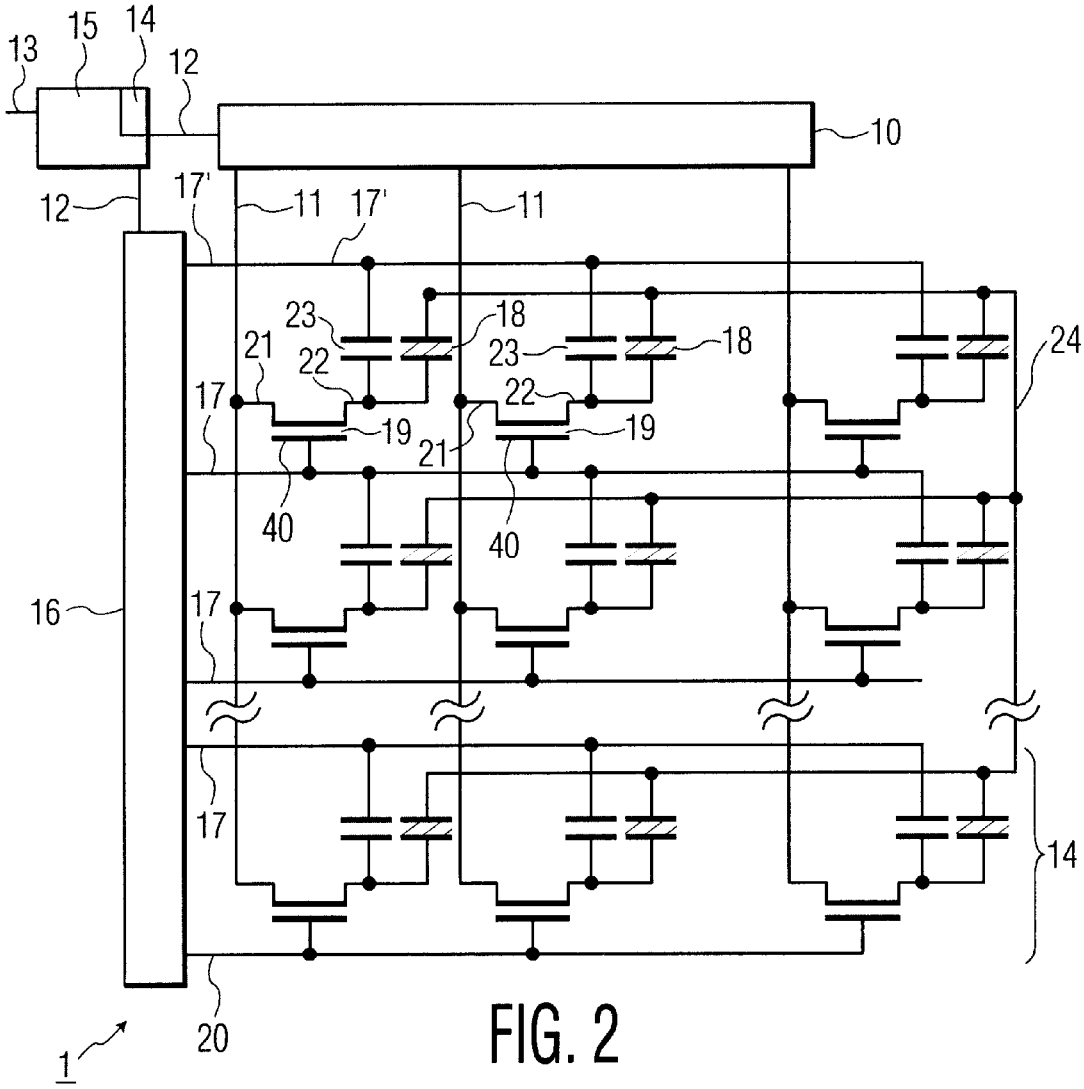
FIG. 2 shows diagrammatically an equivalent circuit diagram of a part of a display device according to the invention.

The voltage across the picture electrodes is determined by the drive mode. FIG. 2 shows diagrammatically a picture display device 1 which is driven with active switching elements, in this example thin-film transistors. It comprises a matrix of pixels 18 at the area of crossings of row or selection electrodes 17 and column or data electrodes 11. The row electrodes are consecutively selected by means of a row driver 16, while the column electrodes are provided with data via a data register 10. If necessary, incoming data 13 is first processed in a processor 15. Mutual synchronization between the row driver 16 and the data register 10 takes place via drive lines 12.

Drive signals from the row driver 16 select the picture electrodes via thin-film transistors (TFTs) 19 whose gate electrodes 40 are electrically connected to the row electrodes 17, and the source electrodes 21 are electrically connected to the column electrodes 11. The signal present at the column electrode 11 is transferred via the TFT to a picture electrode of a pixel 18 coupled to the drain electrode 22. The other picture electrodes are connected to, for example one (or more) common counter electrode(s) 24.

In this embodiment, the display device of FIG. 1 also comprises an auxiliary capacitor 23 at the location of each pixel. In this embodiment, the auxiliary capacitor is connected between the common point of the drain electrode 22 and the pixel in a given row of pixels, on the one hand, and the row electrode of the previous row of pixels, on the other hand. Other configurations are alternatively possible, for example, an auxiliary capacitor between said common point or one of the subsequent rows of pixels (or a previous row). It is to be noted that these auxiliary capacitors do not occur in all display devices based on TFTs.

To prevent picture deviations, the display device of FIG. 2 comprises an extra row electrode 17'.

Figures 3, 4, 5:
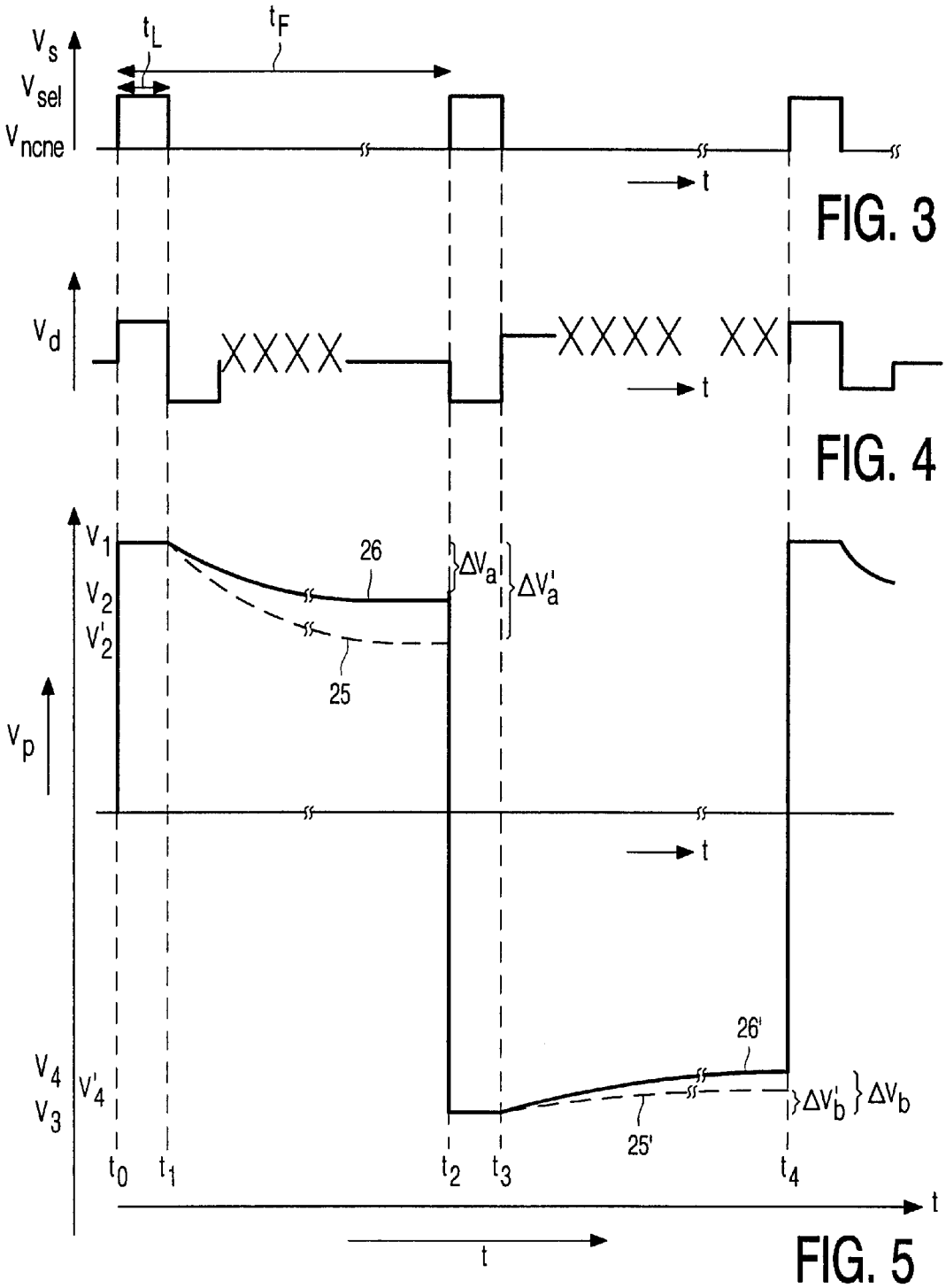

FIGS. 3 and 4 show drive signals of the display device. At the instant $t_0$, a row electrode 17 is energized by means of a signal $V_{sel}$ (FIG. 3), while simultaneously data signals $V_d$ (FIG. 4) are presented to the column electrodes 11. After a line selection time $t_L$ has elapsed, a subsequent row of electrodes is selected at instant $t_1$, etc. After some time, for example, a field time or a frame time, usually 20 msec or 16.7 msec, said row electrode 17 is energized again at instant $t_2$ by means of a signal $V_{sel}$, while simultaneously inverted data signals $V_d$ are presented to the column electrodes 11 (in the case of an unchanged picture). After a line selection time $t_L$ has elapsed, the next row of electrodes is selected at instant $t_3$, etc. This is repeated again at the instant $t_4$.

Since the data voltages are inverted at every subsequent selection of the pixel, the voltage across the pixel changes polarity, as is shown in FIG. 5. During the period when the pixel is not selected, the absolute value of this pixel voltage decreases. The voltage decrease is also dependent on the polarity, notably, but not exclusively, in pixels having an asymmetrical structure, as is the case in reflective display devices or when different materials or thicknesses of, for example, orientation layers on both substrates are used. The voltage decrease is determined by a DC component which is inherent in the structure of the device. After the (positive) selection during the period $t_0$–$t_1$, the (absolute value of the) pixel voltage $V_P$ decreases from $V_1$ to $V_2'$ (broken line 25 in FIG. 5) during the other part $t_1$–$t_2$ of the frame time ($t_f$) without special measures. Likewise, the (absolute value of the) pixel voltage $V_P$ decreases from $V_3$ to $V_4'$ (broken line 25' in FIG. 5) during the other part $t_3$–$t_4$ of the frame time after the (negative) selection during the period $t_2$–$t_3$. Since the voltage decrease for the two polarities $\Delta V_a = V_1 - V_2'$ and $\Delta V_b = V_4' - V_3$ is asymmetrical, this is visible as flicker at half the time frequency (25 or 30 Hz).

According to the invention, the variation of the voltage across one or more pixels is measured; preferably, a row of dummy pixels (not used for the actual display) is controlled for this purpose by means of, for example, the data voltage for medium grey, and one or more control voltages are adapted in such a way that (in this example) $\Delta V_a = \Delta V_b$. The control voltages to be adapted may be data or selection voltages but also, for example the voltage across the counter electrode. The voltage across the pixel then has the variation as shown by the solid lines 26, 26' ($\Delta V_a = V_1 - V_2 = \Delta V_b = V_4 - V_3$). Instead of measuring the voltage difference between the voltages at the beginning and the end of the non-selection period, it is also possible to measure at several positions in the time-voltage curve (or a voltage integral may be determined).

In the case of passive display devices, the switches 19 are absent. Pixels are now defined by overlapping parts of row and column electrodes. For the purpose of measurement, one or more measuring elements are provided which are driven and measured by means of extra electrodes (for example) via the processor 15. Dependent on the measured result, for example, the line selection voltages are adapted.

Figure 6:
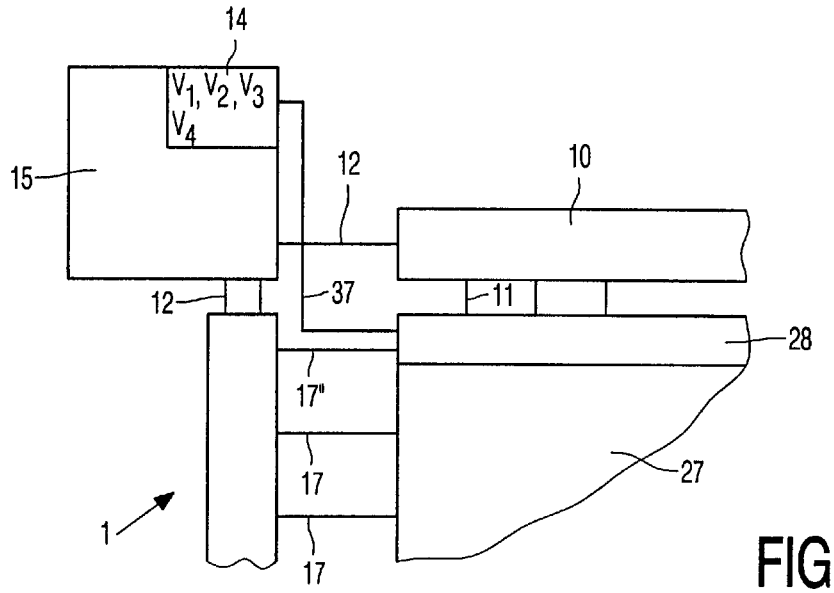
FIG. 6 shows diagrammatically an equivalent circuit diagram of a part of a display device according to the invention.

FIG. 6 shows diagrammatically the display device with a picture area 27 and a row of dummy pixels 28, which functions as a measuring element and is selected by means of a selection electrode 17". The signal across the pixels 28 is simultaneously applied via a measuring electrode 37 to a measuring section 14 of the processor 15 in which the values $V_1$, $V_2$, $V_2'$, $V_3$, $V_4$, $V_4'$ are stored and compared. If necessary, one of the drive signals is adapted until $\Delta V_a = V_1 - V_2 = \Delta V_b = V_4 - V_3$. For the purpose of measurement (and possible adaptation of the bias voltage), the common counter electrode 24 is also connected via a measuring electrode 37 in this embodiment.

Corresponding signals for the picture area 27 are adapted in a similar manner. Instead of a row of dummy pixels, a pixel from the picture area 27 may also be used as a measuring element, for example, prior to its actual use (when the display device is switched on).

Figure 7:
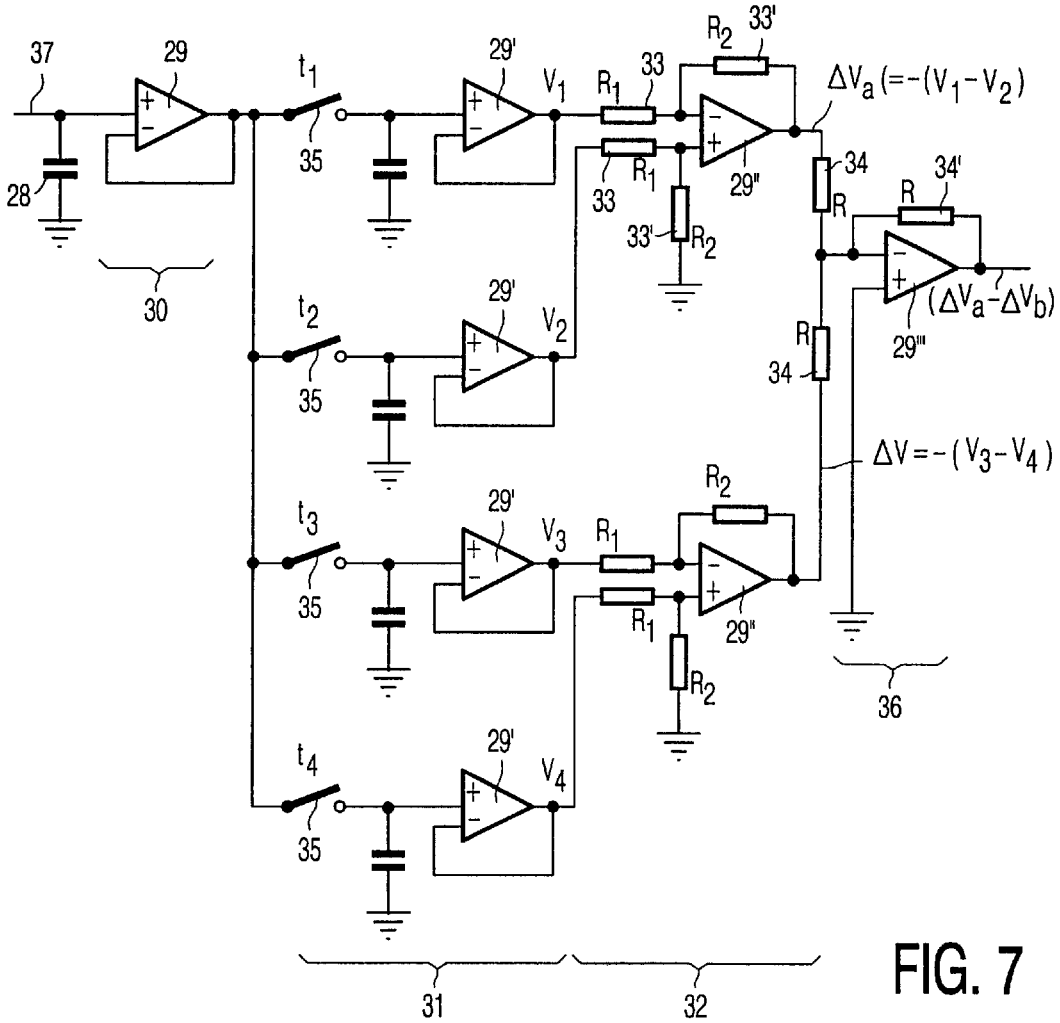
FIG. 7 shows a detail of FIG. 6.

The signal across the dummy pixels 28 is applied via the measuring electrode 37 in the measuring section 14 to an input section 30 with an operational amplifier 29 (FIG. 7). Its output is applied to a sample-and-hold section 31 via switches 35 successively at the instants $t_1$, $t_2$, $t_3$, $t_4$ so that the voltages $V_1$, $V_2$, ($V_2'$), $V_3$, $V_4$, ($V_4'$) are stored via operational amplifiers 29' and subsequently processed in a differential amplifier 32 consisting of operational amplifiers 29" and resistors 33, 33'. The difference voltages $\Delta V_a$, $\Delta V_b$ are compared in the output amplifier 36 consisting of operational amplifiers 29'" and resistors 34, 34'. Dependent on a possible voltage at the output of the output amplifier 29'", one or more control voltages are adapted until $\Delta V_a = \Delta V_b$ or, if necessary, $\Delta V_a = \Delta V_b + c$, in which c is a constant voltage.

It will be evident that many variations within the scope of the invention can be conceived by those skilled in the art. For example, the measuring electrodes may also be spread on the surface of the display device.

In summary, the invention relates to a display device comprising a measuring circuit for detecting flicker due to, for example, DC offset (in both active and passive display devices) and, if necessary, adapting control voltages. The invention is based on each novel characteristic feature and each combination of characteristic features.

What is claimed is:

1. A display device comprising: an electro-optical material between two substrates, at least one of which is transparent, and a first substrate is provided with at least one picture electrode at the location of a pixel, each pixel being coupled to a row electrode and a column electrode, control means comprising first drive means for applying a selection signal to the row electrodes and second drive means for applying a data signal to the column electrodes, a measuring element, wherein the control means comprise means for applying a voltage to the measuring element during a selection period and for measuring the variation of the voltage across the measuring element after the selection period, and for adapting, dependent on the measured voltage variation, at least one of the control voltages of the display device generated by the control means, wherein each pixel is coupled to the row electrode or the column electrode via a switching element, and characterized in that the measuring element comprises a row of pixels.

2. A display device as claimed in claim 1, wherein the display device comprises a reflector, or the picture electrodes on one of the substrates are reflecting.

3. A display device as claimed in claim 1, wherein the adapted control voltage comprises a voltage of a row electrode selection signal.

4. A display device as claimed in claim 1, wherein the control voltage comprises a voltage of a data signal.

5. A display device as claimed in claim 1, wherein the control voltage comprises a reference voltage of the display device.

6. A display device as claimed in claim 1, wherein the second substrate comprises at least one counter electrode and the control voltage comprises a voltage of the counter electrode.

7. A display device as claimed in claim 1 wherein the control means compare the measured voltage variation occurring in a positive polarity frame period with the measured voltage variation that occurs in a successive negative polarity frame period.

8. A display device as claimed in claim 1 wherein the measuring element comprises at least one dummy pixel.

9. The display device as claimed in claim 8 wherein said at least one dummy pixels located in a non-display area of the display device.

10. A display device as claimed in claim 1 wherein the second substrate comprises at least one common counter electrode and the control voltage comprises a voltage of the counter electrode.

11. A display device as claimed in claim 1 wherein said row of pixels comprise a row of dummy pixels located in a non-display area of the display device.

12. A display device as claimed in claim 1 wherein the control means further comprise means for reversing the polarity of the voltage across the measuring element and for measuring the difference between the voltage directly after the selection period and the voltage just before a subsequent selection period, and means for adapting the control voltage of the display device such that the absolute value of the voltage difference for both polarities is substantially the same.

13. The display device as claimed in claim 1 wherein said measuring element comprises at least one pixel located in a display area of the display device.

14. A display device comprising: an electro-optical material between two substrates, at least one of which is transparent, and a first substrate is provided with at least one picture electrode at the location of a pixel, each pixel being coupled to a row electrode and a column electrode, control means comprising first drive means for applying a selection signal to the row electrodes and second drive means for applying a data signal to the column electrodes, a measuring element, wherein the control means comprise means for applying a voltage to the measuring element during a selection period and for measuring the variation of the voltage across the measuring element after the selection period, and for adapting, dependent on the measured voltage variation, at least one of the control voltages of the display device generated by the control means, wherein the control means further comprise means for reversing the polarity of the voltage across the measuring element and for measuring, for both voltage polarities, the difference between the voltage directly after the selection period and the voltage before a subsequent selection period, and means for adapting the at least one control voltage of the display device such that the absolute value of the voltage difference for both polarities is reduced to a minimum.

15. A display device comprising: an electro-optical material between first and second substrates, at least one of which is transparent, the first substrate having at least one picture electrode at the location of a pixel, each pixel being coupled to a row electrode and a column electrode, control means for generating control voltages for the display device and comprising first drive means for applying a selection signal to the row electrodes and second drive means for alternately applying positive and negative data signals to the column electrodes, a measuring element, and the control means comprise means for applying a voltage to the measuring element during a selection period and for measuring the variation of the voltage across the measuring element during successive frame non-selection periods, and for adapting, dependent on the measured voltage variation, at least one of the control voltages of the display device generated by the control means, wherein the measured voltage variation is determined by measuring voltages at two points in a non-selection period, and the measured voltage variation in a positive polarity frame period is compared with the measured voltage variation in a negative polarity frame period, and the control means adapt said at least one control voltage so as to reduce to a minimum any difference in the compared measured voltage variations.

16. A display device comprising: an electro-optical material between first and second substrates, at least one of which is transparent, the first substrate having at least one picture electrode at the location of a pixel, each pixel being coupled to a row electrode and a column electrode, control means for generating control voltages for the display device and comprising first drive means for applying a selection signal to the row electrodes and second drive means for alternately applying positive and negative data signals to the column electrodes, a measuring element, and the control means comprise means for applying a voltage to the measuring element during a selection period and for measuring the variation of the voltage across the measuring element during successive frame non-selection periods, and for adapting, dependent on the measured voltage variation, at least one of the control voltages of the display device generated by the control means, wherein the measuring element comprises at least one pixel located in a display area of the display device.

17. A display device comprising: an electro-optical material between first and second substrates, at least one of which is transparent, the first substrate having at least one picture electrode at the location of a pixel, each pixel being coupled to a row electrode and a column electrode, control means for generating control voltages for the display device and comprising first drive means for applying a selection signal to the row electrodes and second drive means for alternately applying positive and negative data signals to the column electrodes, a measuring element, and the control means comprise means for applying a voltage to the measuring element during a selection period and for measuring the variation of the voltage across the measuring element during successive frame non-selection periods, and for adapting, dependent on the measured voltage variation, at least one of the control voltages of the display device generated by the control means, wherein the control means further comprise means for reversing the polarity of the voltage across the measuring element in successive frame periods and for measuring the difference between the voltage after the selection period and the voltage before a subsequent selection period, and means for adapting the control voltage of the display device such that the absolute value of the voltage difference for both polarities is substantially the same.

* * * * *